US008448913B1

(12) United States Patent
Rohde et al.

(10) Patent No.: US 8,448,913 B1
(45) Date of Patent: May 28, 2013

(54) ANCHOR CABLE RELEASE MECHANISM FOR A GUARDRAIL SYSTEM

(76) Inventors: John R. Rohde, Steamboat Springs, CO (US); John Reid, Lincoln, NE (US); Dean Sicking, Lincoln, NE (US); King K. Mak, San Antonio, TX (US)

( * ) Notice: Subject to any disclaimer, the term of this patent is extended or adjusted under 35 U.S.C. 154(b) by 0 days.

(21) Appl. No.: 13/345,873

(22) Filed: Jan. 9, 2012

(51) Int. Cl.

| | |
|---|---|
| ***F16M 13/00*** | (2006.01) |
| *E04H 17/00* | (2006.01) |
| *E01F 15/00* | (2006.01) |
| *E01F 13/00* | (2006.01) |

(52) U.S. Cl.
USPC ..... 248/548; 248/900; 256/1; 256/13.1; 404/6

(58) Field of Classification Search
USPC ..... 248/218.4, 219.3, 220.42, 220.43, 248/222.51, 222.52, 223.31, 223.41, 224, 248/51, 225.2, 300, 548, 900; 256/13.1; 404/7.8, 9; 211/94.01, 87.01, 103
See application file for complete search history.

(56) References Cited

U.S. PATENT DOCUMENTS

| | | | | |
|---|---|---|---|---|
| 5,775,675 | A * | 7/1998 | Sicking et al. | 256/13.1 |
| 7,344,116 | B2 * | 3/2008 | Ficarra et al. | 248/311.2 |
| 7,878,486 | B2 * | 2/2011 | Ochoa | 256/13.1 |
| 2004/0227041 | A1 * | 11/2004 | Lewis | 248/220.41 |

* cited by examiner

*Primary Examiner* — Jonathan Liu
*Assistant Examiner* — Taylor Morris

(57) ABSTRACT

A highway guardrail terminal having horizontally extending guardrail elements mounted on a plurality of vertical posts. An anchor cable release mechanism having a cable release bracket attached to a W-beam rail element by cable release bolts has an arrangement of tapered slots and elongated openings to quickly release the cable release bracket from the W-beam rail element upon end-on vehicular impact to the terminal. The tapered slots have a geometry which lifts the bracket away from and out of a parallel alignment with the W-beam rail element.

9 Claims, 10 Drawing Sheets

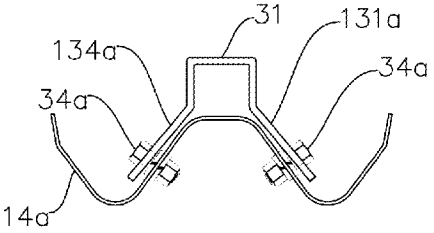
Fig. 2A1
(PRIOR ART)
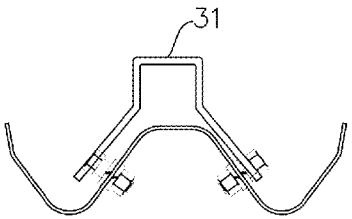
Fig. 2B1
(PRIOR ART)
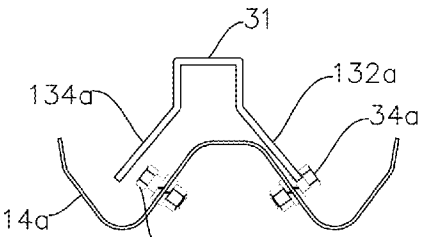
Fig. 2C1
(PRIOR ART)

ANCHOR CABLE RELEASE MECHANISM FOR A GUARDRAIL SYSTEM

BACKGROUND OF THE INVENTION

The present invention relates to improvements in existing anchor cable release mechanisms utilized in guardrail terminal systems. U.S. Pat. No. 6,109,597 discloses in detail an existing anchor cable mechanism. U.S. Pat. No. 6,109,597 in its entirety is incorporated herein by reference for all purpose.

As will be understood by one of ordinary skill in the art, a cable anchor mechanism is used to transmit tensile forces from the rail element to the anchor or foundation in impacts with the longitudinal face of the guardrails. For end-on impacts into the terminal, the cable anchor assembly must be able to release from the anchor or the rail element; otherwise, the cable anchor assembly will impede the forward movement of the impacting vehicle. U.S. Pat. No. 6,109,597 discloses an anchor cable release mechanism that facilitates quick release of the anchor cable bracket from the W-beam rail element. However, it has been found that when the anchor bracket is released from the W-beam rail element it is lifted away from but generally parallel to the W-beam rail element. This created a condition where the bracket was moved into alignment for impact with the next downstream support post causing additional loads on the impact head and the impacting vehicle. The present invention provides unique tapered slot geometry and angled release ramp surfaces on the bracket which lifts the bracket away from and generally out of parallel alignment with the W-beam rail element. Thus the path of the anchor bracket in the present invention is changed from parallel to the W-beam rail element to a path where the downstream end of the anchor bracket is urged away from a direct hit on the post immediately downstream of the anchor mechanism thereby improving the performance of the terminal.

Special quick release anchor cable bracket attachment bolts have a unique structure to reduce frictional contact forces when the bracket is being released from the guardrail. Opposing flat edges allow for the use of a conventional wrench to attach the bolts to the guardrail while opposing radiused edges reduce adverse interactions of the bolt head with the bracket.

To further enhance the desired path of the downstream end of the bracket away from the rail, the leading edge of the anchor impact surface of the terminal guide tube is tapered to increase the moment on the anchor bracket away from the W-beam rail element. The tapered surface applies force closer to the W-beam rail element on the upstream side of the anchor bracket during impact effectively directing the downstream end of the anchor bracket away from and out of parallel alignment with the W-beam rail element.

BRIEF DESCRIPTION OF THE DRAWINGS

The invention will be better understood and objects other than those set forth above will become apparent when consideration is given to the following detailed description of the preferred embodiments. Such description makes reference to the annexed drawings where in:

FIG. 2A1 is an end view of the prior art bracket of FIG. 2 affixed to the W-beam rail at the position of the bracket in FIG. 2A.

FIG. 2B1 is an end view of the prior art bracket of FIG. 2 affixed to the W-beam rail at the position of the bracket in FIG. 2B.

FIG. 2C1 is an end view of the prior art bracket of FIG. 2 affixed to the W-beam rail at the position of the bracket in FIG. 2C lifted away from and generally parallel to the W-beam rail.

DETAILED DESCRIPTION OF THE PREFERRED EMBODIMENTS

Figure 1A:
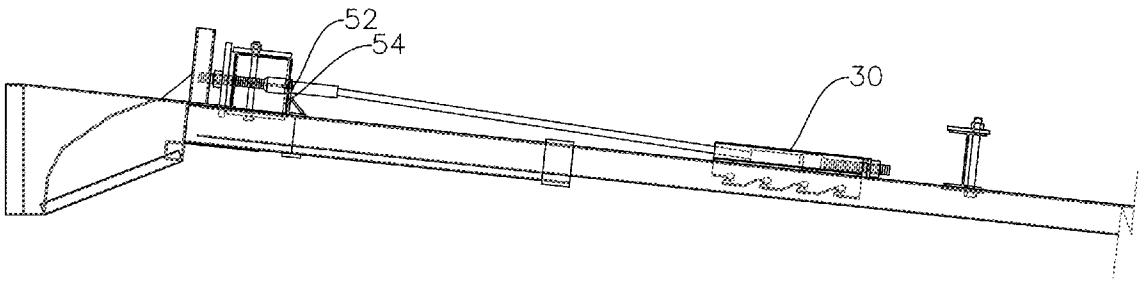
FIG. 1A shows a top view of the improved anchor cable release mechanism of FIG. 1.
Figure 1:
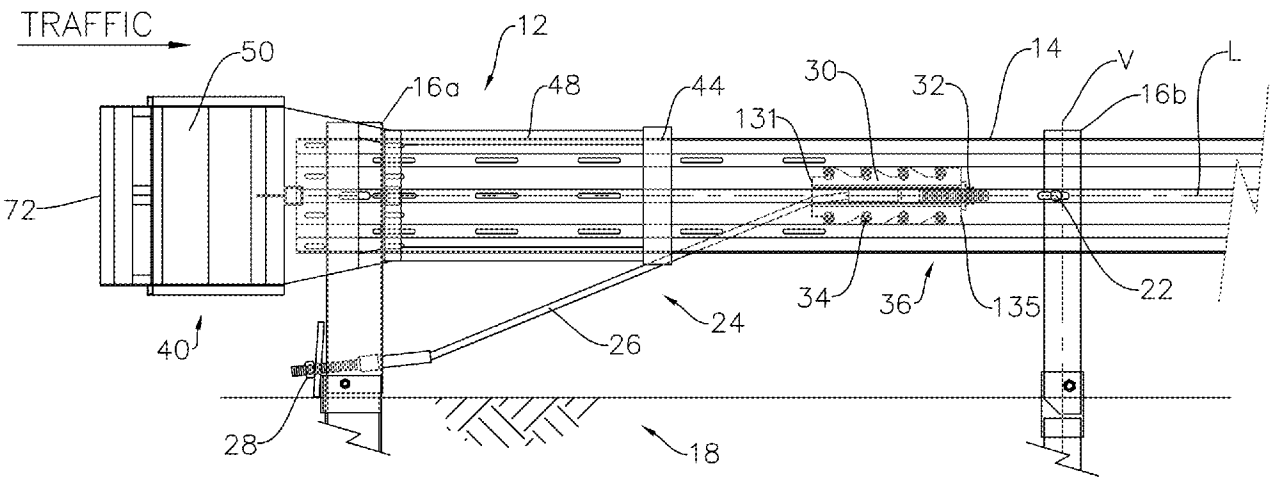
FIG. 1 illustrates a side elevation view of a first embodiment of a highway guardrail terminal system embodying the improved anchor cable release mechanism.

Referring now to the drawings, and more particularly to FIG. 1, the reference numerical 12 generally represents an energy dissipating guardrail terminal. The terminal is adapted to be connected to the upstream side of a conventional guardrail 14 consisting of standard W-beam guardrail sections between 12'6" and 25' in length. The guardrail sections or rail elements are attached along their vertical axes V by bolts 22 to a plurality of spaced apart vertical breakaway posts 16*a*-16*b*. Any suitable number of posts may be used depending upon the expanse of the guardrail run. FIG. 1 illustrates two steel breakaway posts. Steel posts downstream from lead posts 16*a* and 16*b* may be embedded directly into the soil 18.

FIG. 1 further illustrates the anchor cable mechanism 24 of the present invention which includes an anchor cable 26 a lower anchor cable bolt 28, an improved, unique, and novel anchor cable release bracket 30, an upper anchor cable bolt 32, and eight anchor bracket attachment bolts 34. The anchor cable mechanism is provided to allow the terminal 12 to withstand angular vehicle impacts downstream of its upstream end 36.

It is intended that a vehicle will impact the guardrail 14 downstream of its upstream end 36; however, a collision with the upstream end 36 requires the provision of an end treatment 40 to reduce the extent of injury to the impacting vehicle and its occupants. The purpose of the end treatment is to dissipate impact energy of the vehicle. There are a number of existing prior art treatments which are compatible with the instant invention. Including, but not limited to, the sequential kinking terminal (SKT) and the bursting energy terminal (BET).

The impact head portion 50 of the end treatment 40 is attached on the upstream end of a guide tube 48. Guide tube 48 is mounted onto lead post 16*a* by fasteners 52 passing through post angle brackets 54. The upstream end 36 of the W-beam rail element 14 extends into the guide tube 48. Guide tube 48 has an anchor bracket impact shoulder 44 with a leading tapered edge which impacts with the upstream end 131 (FIG. 3) of anchor cable release bracket 30 when the impact head 50 is urged downstream upon a vehicular impact.

When the end treatment 40 is impacted end-on by an errant vehicle, an impact plate 72 will engage and interlock mechanically with the front of the vehicle. As the vehicle proceeds forward, the impact head 50 will be moved forward or downstream along the W-beam rail element 14. Post 16*a* is provided with a hole through which passes a portion of the anchor cable 26. When the impact head is displaced downstream in a collision, post 16*a* will snap or break, thus, releasing the tension on the cable 26 of the anchor cable mechanism 24.

At or shortly after breaking the lead post 16*a*, the upstream end 36 of the W-beam rail element 14 will be treated within the impact head to dissipate impact energy. As the vehicle proceeds forward and pushes the impact head 50 along, the downstream portion of the guide tube 48 reaches the upstream end 131 of anchor cable release bracket 30 on the rail element 14. The anchor cable release bracket, which is held on the W-beam rail element 14 by the anchor cable release bracket attachment bolts 34, will be pushed forward, slide off the bolts 34, rotate out of parallel alignment with and be released from the W-beam rail element 14.

For impacts that are either end-on at a large angle or near the end of the end treatment 40 (e.g., between lead post 16*a* cable anchor bracket 30), the impacting vehicle will break off the posts, bend the W-beam rail element, and gate behind the end treatment and guardrail installation.

For impacts into the side of the terminal downstream of the beginning of length-of-need, the terminal 12 will act like a standard guardrail section and will contain and redirect the impacting vehicle. The anchor cable mechanism will provide the necessary anchorage to resist the tensile forces acting on the rail element to contain and redirect the vehicle.

Figure 2:
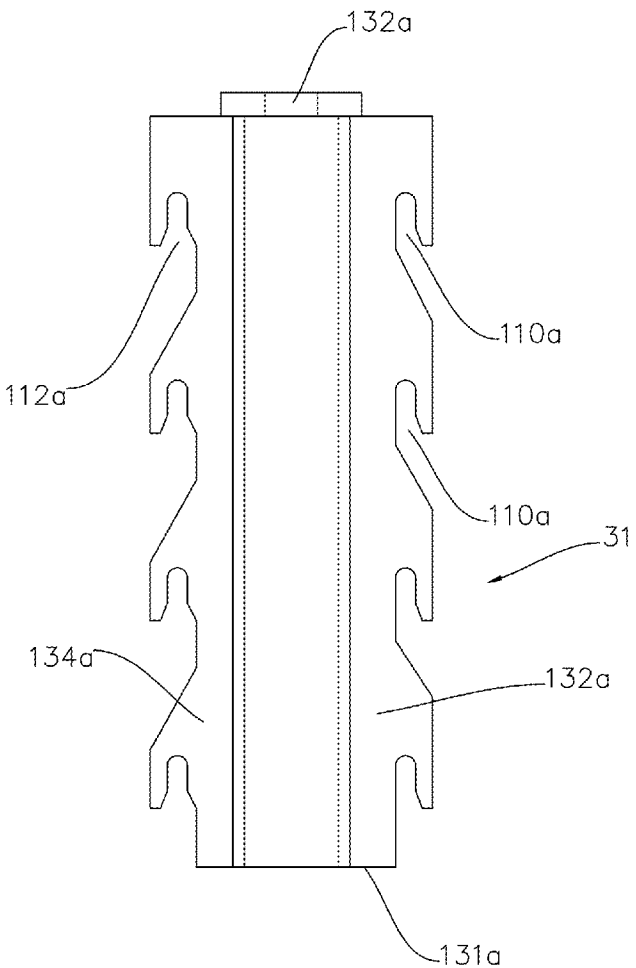
Fig. 2 (PRIOR ART)
FIG. 2 illustrates top plan view of a cable release bracket of the prior art.

FIG. 2 illustrates a top plan view of the anchor cable release bracket 31 of the prior art. The prior art cable release bracket 31 has tapered or wedged slots 110*a* on a top side 134*a* and enlarged openings 112*a* which fit behind the mounting bolts on the opposite bottom side 132*a*. (In FIGS. 2A1 through 2C1 it may be seen that the top side 134*a* of the prior art bracket 31 lies in a different plane than the bottom side 132*a*). The shape or geometry of the tapered slots 110*a* are all identical to one another, as the shape or geometry of the enlarged openings are identical to one another. Further, it should be understood that since the anchor cable release bracket is used on guardrail sections on both sides of the highway, the "top" side of the bracket becomes the "bottom" side of the bracket when used on the left side of the highway as opposed to the right sight side of the highway.

Turning to FIGS. 2A through 2C and FIGS. 2A1 through 2C1, it may be seen what occurs with the prior art bracket 31 in head-on impacts. The upstream end 131*a* of the bracket 31 is impacted by a guide tube 48*a* which pushes the bracket 31 forward releasing the bracket from the mounting bolts 34*a* attached to a W-beam rail element 14*a*. However, it should be noted that as the bracket 31 is lifted away from the W-beam rail element, the bracket 31 remains in a generally parallel alignment with the W-beam element during the forward movement and is directed in a path towards the downstream post 16*c*.

Figure 2C:
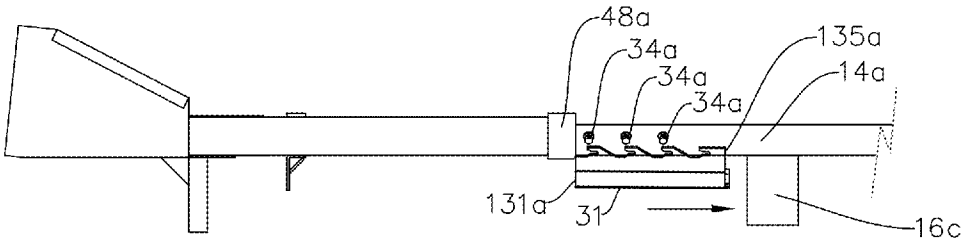
Fig. 2C (PRIOR ART)
FIG. 2C shows a top view of a terminal head of the prior art further shifting the prior art cable release bracket downstream; releasing the bracket from the anchor bracket attachment bolts; and lifting the bracket away from but generally parallel the W-beam rail as the bracket is urged further downstream upon impact. The anchor bracket is shown being forced directly towards a downstream post.
Figure 2B:
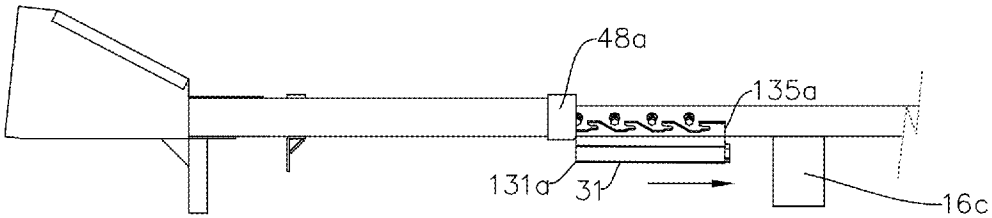
Fig. 2B (PRIOR ART)
FIG. 2B shows a top view of the terminal head of FIG. 2A further shifting the cable release bracket of the prior art downstream on impact of a vehicle.
Figure 2A:
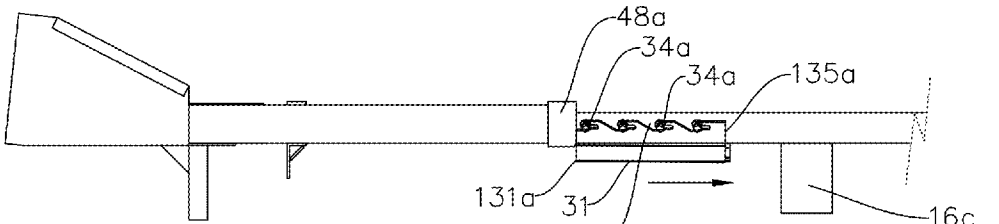
Fig. 2A (PRIOR ART)
FIG. 2A illustrates a top view of a terminal head initially impacting and shifting an anchor cable release bracket of the prior art.

FIG. 2A illustrates a top view of the prior art terminal guide tube 148*a* initially impacting and shifting an anchor cable release bracket 31 of the prior art.

FIG. 2A1 is an end view of the prior art bracket 31 of FIG. 2 affixed to the W-beam rail element 14*a* at the position of the prior art bracket 31 in FIG. 2A.

FIG. 2B shows a top view of the prior art terminal guide tube 148*a* of FIG. 2A further shifting the cable release bracket 31 of the prior art downstream on impact of a vehicle.

FIG. 2B1 is an end view of the prior art bracket 31 of FIG. 2 affixed to the W-beam rail element 14*a* at the position of the prior art bracket in FIG. 2B.

FIG. 2C shows a top view of a guide tube 148*a* of the prior art further shifting the prior art cable release bracket 31 downstream; releasing the bracket from the anchor bracket attachment bolts 34*a;* and lifting the bracket 31 away from but generally parallel the W-beam rail element 14*a* as the bracket 31 is urged further downstream upon impact. The prior art anchor bracket 31 is shown being forced directly towards a downstream post 16*c*.

FIG. 2C1 is an end view of the prior art bracket 31 of FIG. 2 affixed to the W-beam rail element 14*a* at the position of the prior art bracket 31 in FIG. 2C lifted away from and generally in parallel alignment with the W-beam rail element 14*a*

Figure 3:
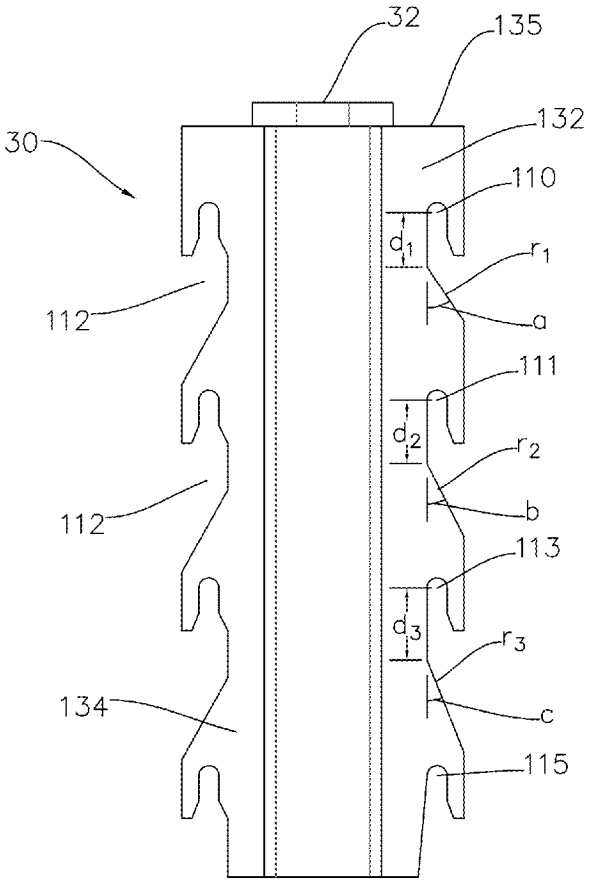
FIG. 3 illustrates top plan view of a cable release bracket of the present invention.

FIG. 3 illustrates as top plan view of the anchor cable release bracket 30 of the present invention. An improvement to the present bracket 30 is the incorporation of uniquely shaped tapered slots 110, 111, and 113 on the bottom side 132 of the bracket. FIG. 4A illustrates a bottom side perspective view of the anchor cable bracket 30 showing that each of the tapered slots (110,111,113) has a flat, bolt slide surface (d1, d2, d3) intersecting with an angled, release ramp surface (r1, r2, and r3). The length of the flat, bolt slide surfaces (d1, d2, and d3) increases progressively in length (d1<d2, <d3) from upstream slot 110, to downstream slot 111, and to downstream-most slot 112. As may be seen in FIG. 4A and FIGS. 5 thru 5C, the length of the flat, bolt slide surface extends from a first end at the intersection with the angled, release surface to a second end in perpendicular alignment with a center of a U-shaped curved portion of each of the tapered slots. In one embodiment the length of the flat bolt slide surface progresses from 0.75" to 1.50". FIGS. 3 and 4A further illustrate the increasing steep ramp angles (a, b, and c) of angled release surface of the tapered slots 110, 111, and 113 (a<b<c). The angled release surfaces may range from 45 degrees to 80 degrees.

This unique geometry of the tapered slots allows the anchor cable release bracket 30 to move away from and out of parallel alignment with the W-beam rail element 14 beginning at a downstream end 135 of the anchor cable release bracket 30 as tension is released from the anchor cable 26 and the bracket 30 is urged downstream by impacting forces.

The progressively increasing length of the flat, bolt slide surface and the variations in the angled release surface may be used in combination or individually with the present system.

Figure 3C:
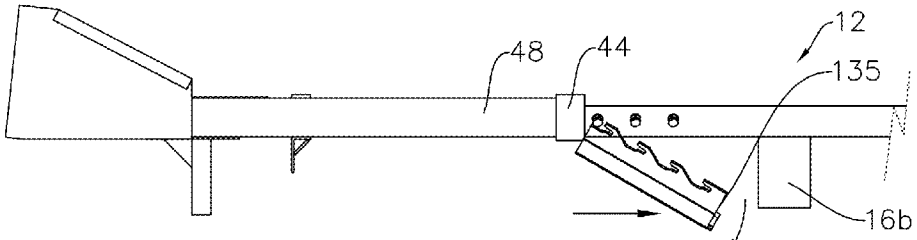
FIG. 3C shows the top view of the terminal head of FIG. 3A shifting the bracket of FIG. 3 downstream; releasing the bracket from the anchor bracket attachment bolts of the present invention; lifting the bracket away from and out of parallel alignment with the W-beam rail and laterally away from the downstream post.
Figure 3B:
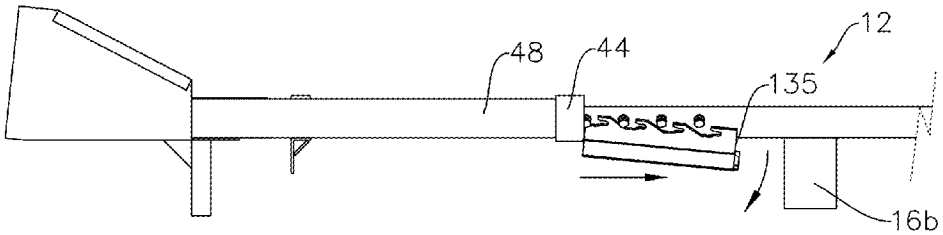
FIG. 3B shows a top view of the terminal head of FIG. 3A further shifting the cable release bracket of FIG. 3 downstream after impact of the vehicle.
Figure 3A:
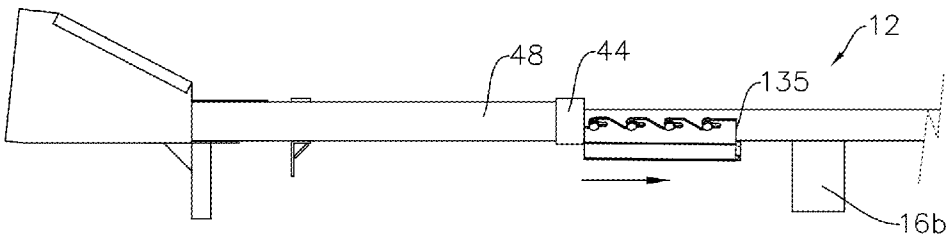
FIG. 3A illustrates a top view of a terminal head of the present invention initially impacting and shifting downstream an anchor cable release bracket of the present invention

FIG. 3A illustrates a top view of a portion of the terminal 12 of the present invention initially impacting and shifting downstream an anchor cable release bracket of the present invention. FIG. 3A shows the bracket 30 sliding in the elongated openings 112 with the downstream-most end 135 of the bracket moving directly downstream toward the second post 16*b*. It should be understood that the lead post 16*a* has already broken. A detail view of a portion of FIG. 3*a* is shown in FIG. 6A.

Figure 6A:
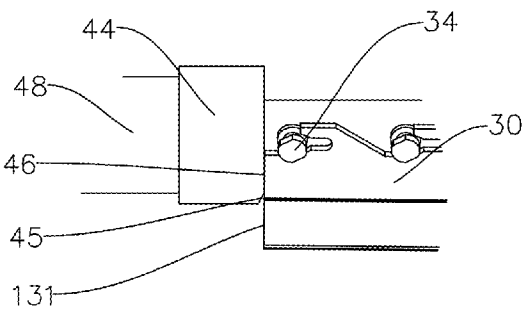
FIG. 6A is a detailed illustration of a portion of FIG. 3A showing the impact shoulder of the guide tube initially impacting the upstream edge of the anchor release bracket and sliding the bracket downstream and the attachment bolt out of the enlarged opening on the top of the bracket.

FIG. 6A is a detailed illustration of a portion of FIG. 3A showing the impact shoulder 44 of the guide tube 48 initially impacting the upstream edge 131 of the anchor release bracket 30 and sliding the bracket downstream. An anchor bracket attachment bolt 34 is shown sliding out of the enlarged opening on the top of the bracket 30. It should also be noted in FIG. 6A anchor impact surface 46 of the anchor impact shoulder has a tapered leading edge 45 for increasing the moment of cable release bracket 30 away from W-beam rail element 14. This will be seen more clearly in FIG. 6B described below.

FIG. 3B shows a top view of a portion of the terminal of FIG. 3A further shifting the cable release bracket 30 of FIG. 3 downstream after impact of the vehicle. FIG. 3B shows the bracket attachment bolts 34 out of the enlarged openings 112, lifted away from and moving out of parallel alignment with the W-beam rail element. The directional arrow indicates that the bracket 30 is rotating away from a direct hit on the downstream post 16*b*. A detailed view of a portion of FIG. 3B is shown in FIG. 6B.

Figure 6B:
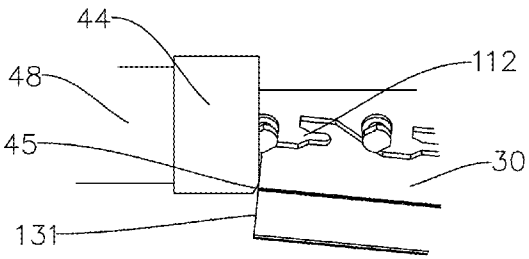
FIG. 6B is a detailed illustration of a portion of FIG. 3B showing the impact edge of the impact shoulder urging the bracket to rotate out of parallel alignment with the W-beam rail.

FIG. 6B is a detailed illustration of a portion of FIG. 3B showing the tapered leading impact edge 45 of the impact shoulder 44 urging the bracket 30 to rotate out of parallel alignment with the W-beam rail. As the bracket 30 rotates more of the leading impact edge 45 contacts the upstream edge 131 of the bracket 30. Urging it further out of alignment of a direct hit on the downstream post 16*b*

FIG. 3C shows the top view of a portion of the terminal 12 of FIG. 3A shifting the bracket of FIG. 3 downstream; releasing the bracket 30 from the anchor bracket attachment bolts 34 of the present invention; lifting the bracket 30 away from and out of parallel alignment with the W-beam rail 14 and laterally away from the downstream post 16*b*. A detailed view of a portion of FIG. 3C is shown in FIG. 6C.

Figure 6C:
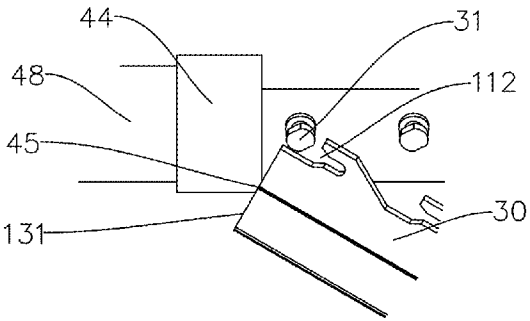
FIG. 6C is a detailed illustration of a portion of FIG. 3C showing the full contact of the tapered impact edge engaging the upstream end of the anchor cable release bracket at it is lifted away from and rotated out of parallel alignment with the W-beam.

FIG. 6C is a detailed illustration of a portion of FIG. 3C showing the full contact of the tapered impact edge 45 engaging the upstream end 131 of the anchor cable release bracket 30 as it is lifted away from and rotated out of parallel alignment with the W-beam.

Figure 4B:
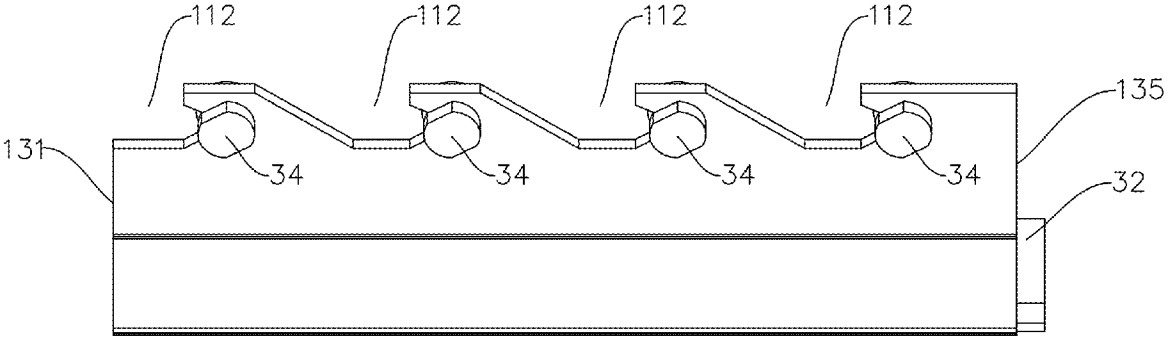
FIG. 4B illustrates a perspective view of the top side of the anchor cable release bracket of the present invention showing the identical enlarged openings of the bracket.
Figure 4A:
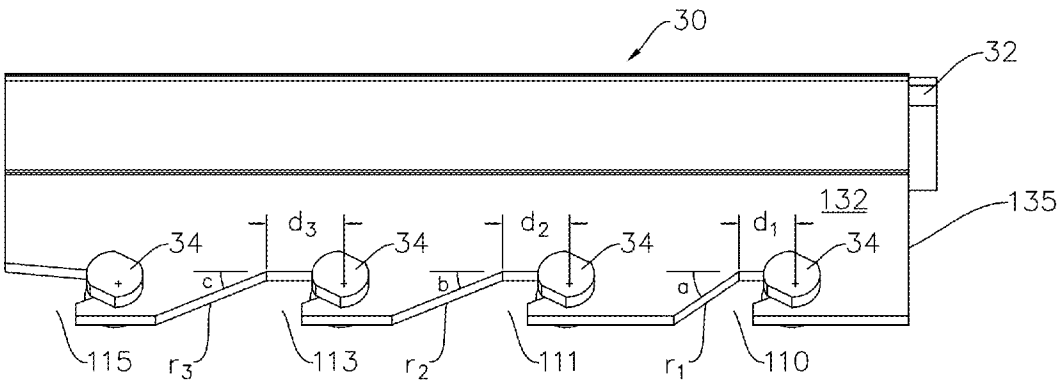
FIG. 4A illustrates a perspective view of the bottom side of the anchor cable release bracket of the present invention showing the progressively increasing length (d1, d2, d3) of the bolt slide surface of the tapered slots of the bracket. The length of the flat, bolt slide surface extends from a first end at the intersection with the angled, release surface to a second end in perpendicular alignment with a center of a U-shaped curved portion of each of the tapered slots, as may be seen in FIGS. 5 thru 5C.

FIG. 4B illustrates a perspective view of the top side of the anchor cable release bracket 30 of the present invention showing the identical enlarged openings 112 of the bracket.

Figure 5:
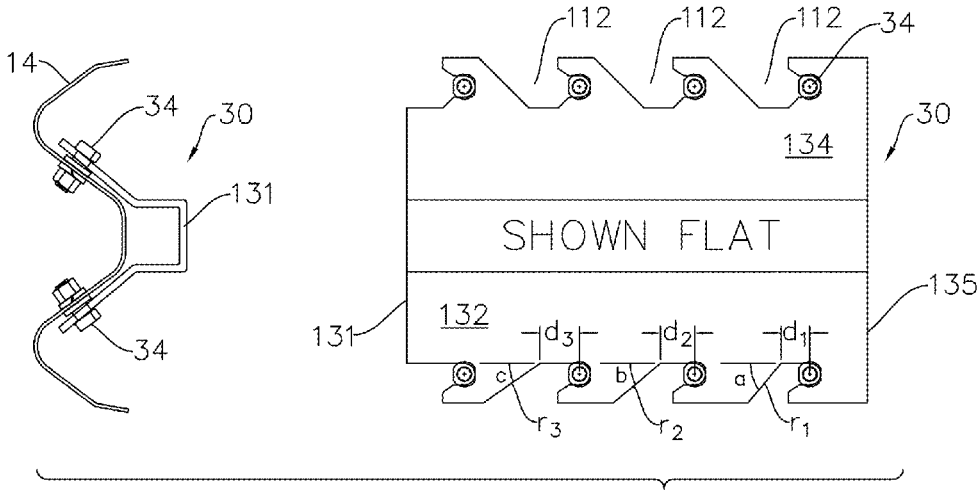
FIG. 5 is a combination illustration showing the relationship of the anchor cable release bracket to the W-beam in an end view alongside of a top plan view of the anchor release bracket correspondingly affixed to the anchor release attachment before the bracket is impacted by the terminal head anchor impact surface (not shown).

FIG. 5 is a combination illustration showing the relationship of the anchor cable release bracket 30 to the W-beam rail element 14 in an end view alongside of a top plan view of the anchor release bracket 30 correspondingly affixed to the anchor release attachment bolts 34 before the bracket is impacted by the anchor impact surface 45 (not shown).

Figure 5A:
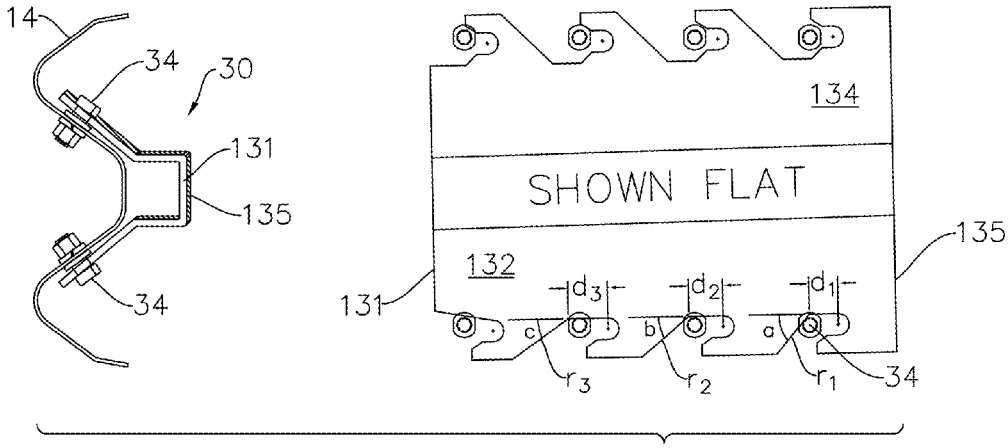
FIG. 5A is a combination illustration similar to FIG. 5 showing the shift of the bracket upon impact of a vehicle with the bracket beginning to slide on the attachment bolts. The bolts 34 are shown spaced apart from the U-shaped curved portion of the tapered slots. The end view of the W-beam shows that the bracket has not lifted from the W-beam at this point.

FIG. 5A is a combination illustration similar to FIG. 5 showing the shift of the bracket 30 upon impact of a vehicle showing the bracket 30 beginning to slide along the length (d1, d2, d3) of the flat, bolt slide surfaces on the attachment bolts 34. The attachment bolts 34 are shown spaced apart from the U-shaped curved portion of the tapered slots. The end view of the W-beam rail element shows that the bracket has not lifted from the W-beam rail element at this point.

Figure 5B:
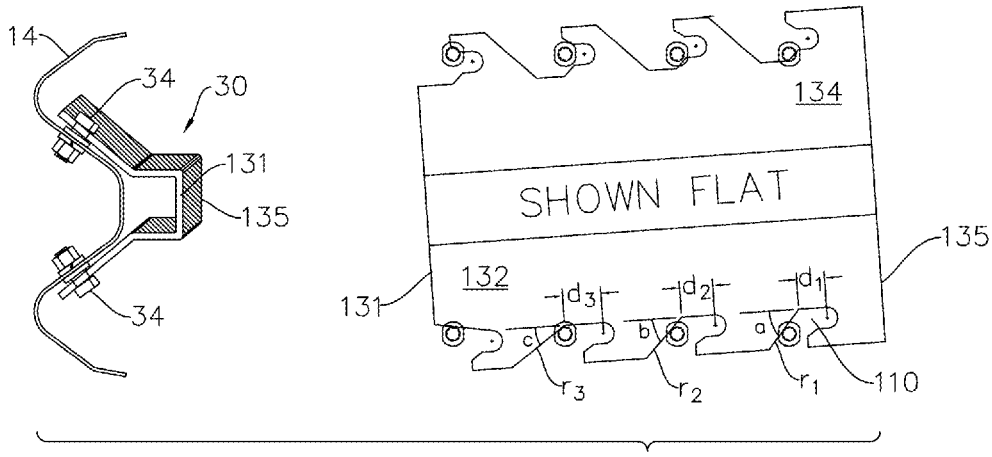
FIG. 5B is a combination illustration similar to FIG. 5A showing the further shift of the bracket after impact of the vehicle with the bracket having slid downstream on the attachment bolts and along the bolt slide surface of the tapered slots and starting to slide up the angled release ramp surface. The end view of the W-beam shows that the bracket has begun to lift and rotate from the W-beam on the downstream end of the bracket.

FIG. 5B is a combination illustration similar to FIG. 5A showing the further shift of the bracket 30 after impact of the vehicle with the bracket having slid downstream on the attachment bolts 34 and along the bolt slide surfaces of the tapered slots and starting to slide up the angled release ramp surface r1 of slot 110. The end view of the W-beam rail element 14 shows that the bracket 30 has begun to lift and rotate from the W-beam rail element on the downstream end 135 of the bracket (both the upstream end 313 and the downstream end 135 may be seen in end-view of FIG. 5B).

Figure 5C:
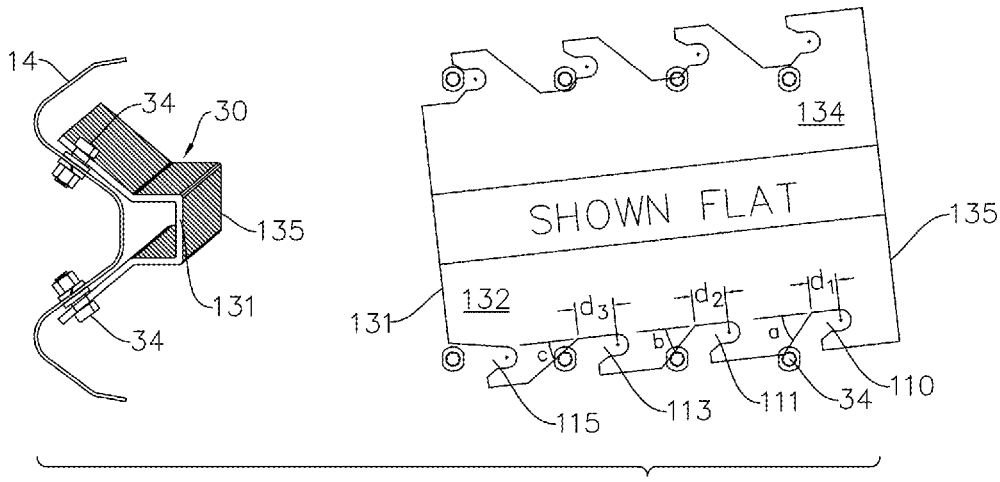
FIG. 5C is a combination illustration similar to FIG. 5B showing the further shift of the bracket after impact of the vehicle with the bracket having slid further downstream with the upper elongated openings free of the attachment bolts and the lower having slid up the angled release ramp surfaces of the tapered slots. The downstream end of the bracket is shown in the end view of the W-beam as having been pushed away and more fully rotated out of a parallel alignment with the W-beam.

FIG. 5C is a combination illustration similar to FIG. 5B showing the further shift of the bracket 30 after impact of the vehicle with the bracket having slid further downstream with the upper elongated openings free 112 of the attachment bolts 34 and the attachment bolts in the tapered slots having slid up the angled release ramp surfaces r1, r2, and r3 of the tapered slots. The downstream end 135 of the bracket 30 is shown in the end view of the W-beam rail element 14 as having been pushed away and more fully rotated out of a parallel alignment with the W-beam rail element (more of the downstream end 135 of the bracket 30 may be seen in FIG. 5C).

Figure 7:
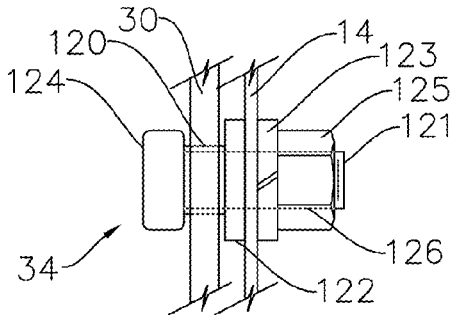
FIG. 7 illustrates a side elevation view of the improved quick release anchor cable bracket attachment bolt of the present invention.

FIG. 7 illustrates a side elevation view of the quick release anchor cable bracket attachment bolt 34 of the present invention. To further improve release of the anchor cable system 24 the bracket 30 is attached to the W-beam rail element 14 by specially designed attachment bolts 34. FIG. 7 illustrates that bolt 34 is provided with a shank 126 having a first threaded end 121 extendable through an opening in the W-beam rail element 14; a head 124 rigidly attached to a second end of the shank 126; a fixed spacer 122 rigidly attached to a middle portion of said shank and spaced apart from said head providing a space for releasable retaining said anchor cable release bracket 30; and an internally threaded locknut 125 adapted to be received on first threaded end 121 of the shank to retain the cable bracket attachment bolt to the W-beam rail element 14.

The first end 121 of the shank 126 is threaded to accept the locknut 125. The washer or spacer 122 is welded or otherwise rigidly affixed to a middle portion the shank so as to provide a fixed gap or space between the head 124 and the spacer 122. The bolts 34 are affixed to the W-beam rail element 14 by passing the threaded end 121 of the shank 126 through a hole or slot in the W-beam rail element 14 and tightening washer 123 against the back side of the W-beam rail element with the locknut 125. Because the fixed space between the head 124 and the spacer 122 is greater than the thickness of the bracket 30, and because the bracket 30 may slide easily over the bolt sleeve, the bracket 30 is quickly and easily release upon a head-on impact.

In assembly tapered slots (110, 111, 113, and 115) and the elongated openings 112 of the anchor cable release bracket 30 slides between the head 124 and the spacer 122. This configuration ensures that the attachment bolts 34 may not be improperly arranged on the W-beam rail element 14 upon assembly.

Figure 7A:
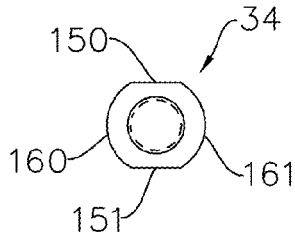
FIG. 7A is an end view of the improved quick release anchor cable bracket attachment bolt showing the opposing flat edges and the opposing radiused edges.

FIG. 7A shows the unique structure of the bolt heads 124. Opposing flat edges 150 and 151 allow for the use of a conventional wrench or other tightening devices to install the bolts to the guardrail. However, the opposed radiused edges 160 and 161 reduce adverse interaction (frictional contact forces) of the bolt head 124 with the bracket 30 upon bracket release.

Figure 8:
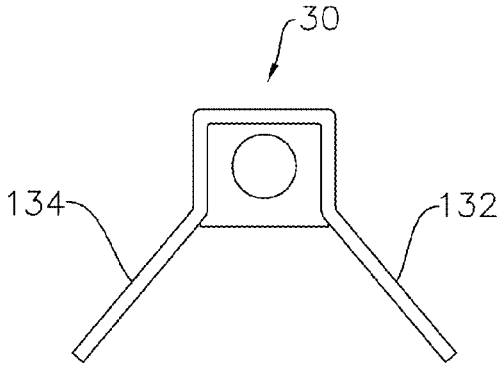
FIG. 8 illustrates and end view of the cable release bracket of the present invention.

FIG. 8 illustrates and end view of the cable release bracket of the present invention. It may be seen that the sides 132 and 134 of bracket 30 lie in two different planes. Having the tapered slots (110, 111, 113, and 115) on one side and the enlarged openings 112 on the other side allows the bracket 30 to be affixed to the W-beam rail element in two rows in two different slip planes and still be lifted off the w-beam rail element 14 when the bracket 30 is pushed forward in a collision.

Although the invention has been described with reference to specific embodiments, the description is not meant to be construed in a limited sense. Various modifications of the disclosed embodiments, as well as alternative embodiments of the invention will become apparent to persons skilled in the art upon the reference to the description of the invention. It is, therefore, contemplated that the appended claims will cover such modifications that fall within the scope of the invention.

The invention claimed is:

1. An anchor cable release mechanism in combination with a guardrail system, said guardrail system having a W-beam rail element, an anchor impact surface, and an anchor cable comprising:

a first set and a second set of cable release bolts connected to a first section of said W-beam rail element of said guardrail system, said first set and said second set of cable release bolts aligned in separate rows along a top side and a bottom side of said W-beam, respectively;

a cable release bracket releasably attachable to said cable release bolts, said bracket having a first side with a plurality of enlarged openings slidingly engageable on said first set of said bolts along said top side of said W-beam rail element, said bracket having a second side with a plurality of tapered slots, said tapered slots slidingly engageable on said second set of bolts along said bottom side of said W-beam rail element, each of said tapered slots having a flat, bolt slide surface intersecting with an angled, release surface, each of said flat, bolt slide surfaces having a length extending from a first end at said intersection with said angled, released surface, each of said flat, bolt slide surfaces having a length extending from a first end at said intersection with said angled, release surface, to a second end in perpendicular alignment with a center of a U-Shaped curved portion on each of said tapered slots, said length of said flat, bolt slide surface increasing progressively from a upstream most slot to a downstream most slot, said bracket adapted to move away from and out of parallel alignment with said W-beam rail element beginning at a downstream end of said bracket as tension is released from said cable of said guardrail system and said bracket is urged downstream by impacting forces.

2. The anchor cable release mechanism of claim 1 wherein the angled release surface of each tapered slot increases progressively from said upstream most slot to said downstream most slot.

3. The anchor cable release mechanism of claim 1 wherein said anchor impact surface has a tapered leading edge for increasing the moment of said cable release bracket away from said W-beam rail element.

4. The anchor cable release mechanism of claim 1 wherein each of said cable release bolts further comprises:

a shank having a first threaded end extendable through an opening is said W-beam rail element;

a head rigidly attached to a second end of said shank;

a fixed spacer rigidly attached to a middle portion of said shank and spaced apart from said head providing a space for releasable retaining said anchor cable release bracket; and an internally threaded locknut adapted to be received on said first threaded end of said shank to retain said cable release bolt to said W-beam rail element.

5. The anchor cable release mechanism of claim 4 wherein said head has two, flat, opposing edges and two, radiused opposing edges.

6. An anchor cable release mechanism in combination with a guardrail system, said guardrail system having a W-beam rail element, an anchor impact surface, and an anchor cable comprising:

a first set and a second set of cable release bolts connected to a first section of said W-beam rail element of said guardrail system, said first set and said second set of cable release bolts aligned in separate rows along a top side and a bottom side of said W-beam, respectively;

a cable release bracket releasably attachable to said cable release bolts, said bracket having a first side with a plurality of enlarged openings slidingly engageable on said first set of said bolts along said top side of said W-beam rail element, said bracket having a second side with a plurality of tapered slots, said tapered slots slidingly engageable on said second set of bolts along said bottom side of said W-beam rail element, each of said tapered slots having a flat, bolt slide bolt slide surface intersecting with an angled, release surface, the length of said flat, bolt slide bolt slide surface increasing progressively from a upstream most slot to a downstream most slot, said bracket adapted to move away from and out of parallel alignment with said W-beam rail element beginning at a downstream end of said bracket as tension is released from said cable of said guardrail system and said bracket is urged downstream by impacting forces, wherein the angled release surface of each tapered slot increases progressively from said upstream most slot to said downstream most slot.

7. The anchor cable release mechanism of claim 6 wherein said anchor impact surface has a tapered leading edge for increasing the moment of said cable release bracket away from said W-beam rail element.

8. The anchor cable release mechanism of claim 6 wherein each of said cable release bolts further comprises:

a shank having a first threaded end extendable through an opening is said W-beam rail element;

a head rigidly attached to a second end of said shank;

a fixed spacer rigidly attached to a middle portion of said shank and spaced apart from said head providing a space for releasable retaining said anchor cable release bracket; and an internally threaded locknut adapted to be receive on said first threaded end of said shank to retain said cable release bolt to said W-beam rail element.

9. The anchor cable release mechanism of claim 6 wherein said head has two, flat, opposing edges and two, radiused opposing edges.

* * * * *